US007780207B2

(12) United States Patent
Gotou et al.

(10) Patent No.: US 7,780,207 B2
(45) Date of Patent: Aug. 24, 2010

(54) AUTOMOTIVE DOOR LATCH SYSTEM

(75) Inventors: Shingo Gotou, Kanagawa (JP); Shintaro Okawa, Yokohama (JP); Osamu Hamaguchi, Yokohama (JP); Jiro Inoue, Nagoya (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 56 days.

(21) Appl. No.: 11/224,136

(22) Filed: Sep. 13, 2005

(65) Prior Publication Data

US 2006/0076788 A1 Apr. 13, 2006

(30) Foreign Application Priority Data

Oct. 8, 2004 (JP) ..... 2004-296724

(51) Int. Cl.
*E05B 3/00* (2006.01)
*E05C 3/06* (2006.01)

(52) U.S. Cl. ..... 292/336.3; 292/201; 292/216; 292/DIG. 23; 292/DIG. 42

(58) Field of Classification Search ..... 292/336.3, 292/201, DIG. 23, DIG. 25, DIG. 30, DIG. 42, 292/216; 49/302
See application file for complete search history.

(56) References Cited

U.S. PATENT DOCUMENTS 1,184,474 A * 5/1916 Meunier ..... 49/302
2,499,727 A * 3/1950 Craig ..... 292/33
2,563,317 A * 8/1951 Dix et al. ..... 292/171
3,858,922 A * 1/1975 Yamanaka ..... 292/336.3
4,346,925 A * 8/1982 Okada ..... 292/336.3
4,468,941 A * 9/1984 Bascou ..... 70/241
4,917,418 A * 4/1990 Gokee ..... 292/125
4,945,784 A * 8/1990 Gergoe ..... 74/501.5 R
4,974,885 A * 12/1990 Yokoyama ..... 292/201
4,998,758 A * 3/1991 Kowalczyk et al. ..... 292/201
5,222,774 A * 6/1993 Fukumoto et al. ..... 292/144
5,280,881 A * 1/1994 Karmin ..... 70/279.1
5,433,496 A * 7/1995 Zimmermann ..... 292/201
5,535,608 A * 7/1996 Brin ..... 70/256
5,632,515 A * 5/1997 Dowling ..... 292/216
5,660,081 A * 8/1997 Sato ..... 74/502

(Continued)

FOREIGN PATENT DOCUMENTS

DE 4425423 * 8/1995

(Continued)

*Primary Examiner*—Carlos Lugo
(74) *Attorney, Agent, or Firm*—Sughrue Mion, PLLC

(57) ABSTRACT

A door latch system of a motor vehicle comprises a latch unit mounted to the vehicle body. The latch unit has a latch condition to latch the door at a closed position and an unlatch condition to unlatch the door thereby to release the door. The system further comprises a power latch canceling mechanism mounted to the vehicle body. The power latch canceling mechanism includes an actuator that, when energized, enforcedly causes the latch unit to assume the unlatch condition. The system further comprises a manual latch canceling mechanism mounted to the vehicle body. The manual latch canceling mechanism includes a handle member that is placed at a position other than a vehicle cabin of the vehicle and a power transmitting member that transmits a movement of the handle member to the latch unit. The manual latch canceling mechanism causes the latch unit to assume the unlatch condition when the handle member is manipulated.

2 Claims, 5 Drawing Sheets

U.S. PATENT DOCUMENTS

| | | | | |
|---|---|---|---|---|
| 5,662,369 | A * | 9/1997 | Tsuge | 296/66 |
| 5,720,506 | A * | 2/1998 | Arabia et al. | 292/216 |
| 5,901,991 | A * | 5/1999 | Hugel et al. | 292/201 |
| 5,927,794 | A * | 7/1999 | Mobius et al. | 296/146.1 |
| 6,017,067 | A * | 1/2000 | Yoneyama et al. | 292/216 |
| 6,048,002 | A * | 4/2000 | Ohta et al. | 292/201 |
| 6,065,316 | A * | 5/2000 | Sato et al. | 70/264 |
| 6,568,720 | B1 * | 5/2003 | Szablewski | 292/201 |
| 6,776,554 | B2 * | 8/2004 | Acciacca | 403/353 |
| 6,945,585 | B1 * | 9/2005 | Liu et al. | 296/65.03 |
| 6,988,749 | B2 * | 1/2006 | Hashiba et al. | 292/201 |
| 2007/0152455 | A1 * | 7/2007 | Ko et al. | 292/201 |

FOREIGN PATENT DOCUMENTS

| | | | |
|---|---|---|---|
| JP | 63-146066 | U | 9/1988 |

* cited by examiner

AUTOMOTIVE DOOR LATCH SYSTEM

BACKGROUND OF THE INVENTION

1. Field of the Invention

The present invention relates in general to automotive door latch systems that are able to latch an automotive door to a vehicle body, and more particularly to the automotive door latch systems of a type having both a power latch canceling mechanism that cancels the latched condition of the door with the aid of a power produced by an actuator and a back-up manual latch canceling mechanism that cancels the latched condition of the door manually.

2. Description of the Related Art

In order to clarify the task of the present invention, one known automotive door latch system of the above-mentioned type will be briefly described in the following, which is disclosed in Japanese Laid-open Utility Model Application (Jikkaisho) 63-146066.

The door latch system of this publication generally comprises a striker fixed to a vehicle body and a latch unit mounted to a vehicle door. That is, when the door is brought to a close position, the latch unit latches the striker thereby to latch the door at the closed position. For canceling such latch condition of the latch unit, an electric type latch canceling mechanism is employed for easiness with which the latch canceling operation of the latch unit is carried out. In the latch canceling mechanism of this electric type, an electric actuator is employed that, when energized, produces a power by which the latch unit is forced to release the door, more specifically the striker fixed to the door. For energizing the electric actuator, a control switch is arranged on an inner wall of the door, and a portable transmitter is used. Usually, the transmitter is embedded in an engine key. Thus, when the transmitter is manipulated by an operator who is out of the vehicle, the latched condition of the door is cancelled.

In the door latch system of the publication, there is further employed a manual type latch canceling mechanism as a back-up device for the electric type. That is, when the electric type fails to operate, the manual type is temporarily used for releasing the door.

The latch canceling mechanism of manual type comprises a handle member that is mounted on an inner wall of the door and a cable that is carried on the door to transmit movement of the handle member to the latch unit. That is, the handle member is arranged and positioned to be manipulated by a passenger or driver in the vehicle.

SUMMARY OF THE INVENTION

However, due to its inherent construction, the automotive door latch system of the above-mentioned publication has the following drawback.

That is, when, with the door kept latched in its closed position with no passenger in the vehicle, the electric type latch canceling mechanism fails to operate due to shortage of electric power of a battery or the like, the latched condition of the door can not be cancelled by an operator who is out of the vehicle. Because the handle member of the manual latch canceling mechanism is arranged on the inner wall of the door, he or she can not manipulate the handle member, and thus, the door can not be opened.

Accordingly, an object of the present invention is to provide an automotive door latch system which is free of the above-mentioned drawback.

According to the present invention, there is provided an automotive door latch system which has both power and manual latch canceling mechanisms each being constructed to cancel a latched condition of a door when operated. Usually, the power mechanism is used. While, when the power mechanism fails to operate, the manual mechanism is temporarily used. A handle member of the manual mechanism is arranged at a position relatively accessible by a person who is out of the vehicle. Thus, even when the door can not be unlatched due to failure of the power mechanism, the latched condition of the door is easily cancelled by only manipulating the handle member.

In accordance with a first aspect of the present invention, there is provided a door latch system of a motor vehicle having a vehicle body and a door, which comprises a latch unit mounted to the vehicle body, the latch unit having a latch condition to latch the door at a closed position and an unlatch condition to unlatch the door thereby to release the door; a power latch canceling mechanism mounted to the vehicle body, the power latch canceling mechanism including an actuator that, when energized, enforcedly causes the latch unit to assume the unlatch condition; and a manual latch canceling mechanism mounted to the vehicle body, the manual latch canceling mechanism including a handle member that is placed at a position other than a vehicle cabin of the vehicle and a power transmitting member that transmits a movement of the handle member to the latch unit, the manual latch canceling mechanism causing the latch unit to assume the unlatch condition when the handle member is manipulated.

In accordance with a second aspect of the present invention, there is provided a door latch system of a motor vehicle having a vehicle body and a door, which comprises a latch unit mounted to the vehicle body, the latch unit having a latch condition to latch the door at a closed position and an unlatch condition to unlatch the door thereby to release the door; a first latch canceling mechanism mounted to the vehicle body, the power latch canceling mechanism including an electric actuator that, when electrically energized, enforcedly causes the latch unit to assume the unlatch condition; a second latch canceling mechanism mounted to the vehicle body, the second latch canceling mechanism including an inner handle member that is placed in a vehicle cabin of the vehicle and a power transmitting member that transmits a movement of the inner handle member to the latch unit, the second latch canceling mechanism causing the latch unit to assume the unlatch condition when the inner handle member is manipulated; and a third latch canceling mechanism mounted to the vehicle body, the third latch canceling mechanism including an outer handle member that is placed in a trunk room of the vehicle and a power transmitting member that transmits a movement of the outer handle member to the latch unit, the third latch canceling mechanism causing the latch unit to assume the unlatch condition when the outer handle member is manipulated.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, an automotive door latch system of the present invention will be described with reference to the drawings.

For ease of understanding, various directional terms, such as, right, left, upper, lower, rightward and the like are used in the following description. However, such terms are to be understood with respect to only a drawing or drawings on which a corresponding part or portion is shown.

Figure 1:
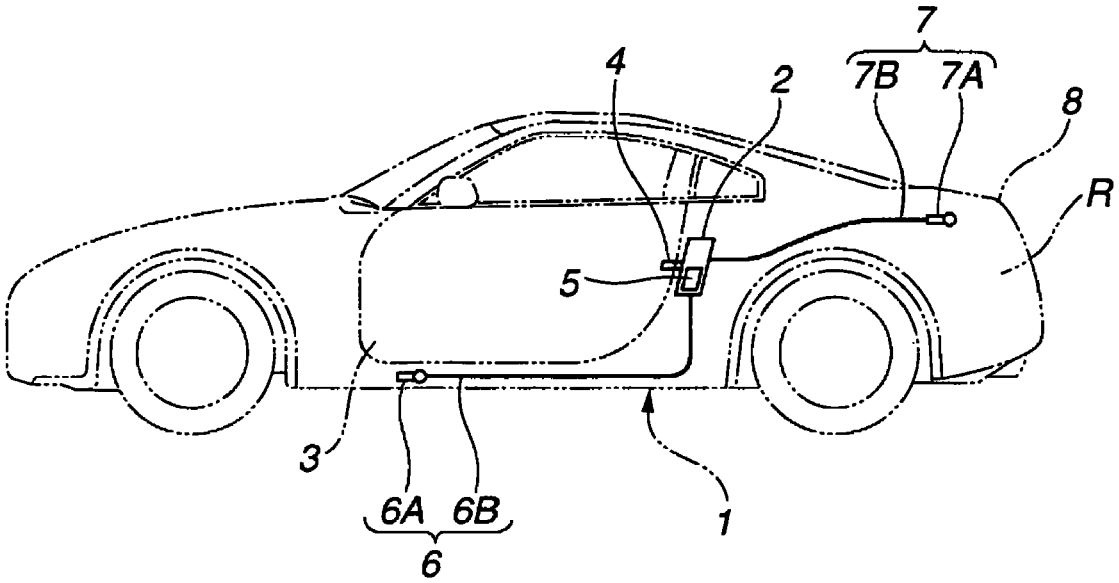
FIG. 1 is a side view of a motor vehicle to which an automotive door latch system of the present invention is practically applied.
Figure 2:
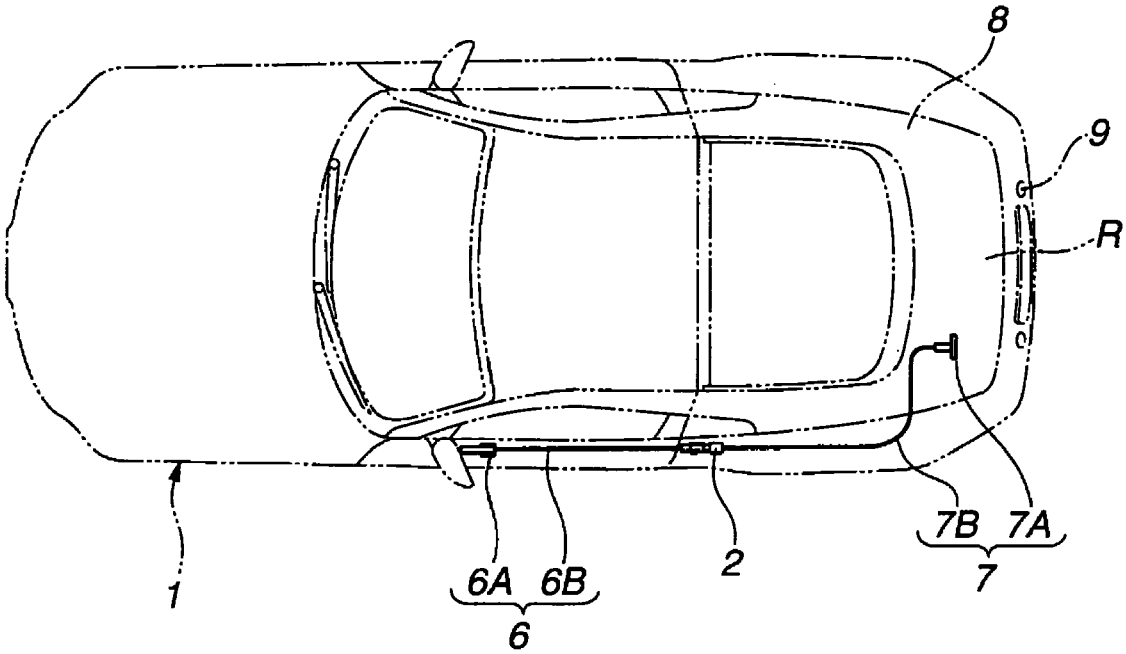
FIG. 2 is a plan view of the motor vehicle to which the automotive door latch system of the present invention is practically applied.

Referring to FIGS. 1 and 2, there is shown a motor vehicle to which an automotive door latch system of the present invention is practically applied.

In these drawings, denoted by numeral 1 is a body of the motor vehicle.

A latch unit 2 is mounted on the vehicle body 1 at a position just behind a door opening. A door 3 is pivotally connected at its front edge to the vehicle body 1 to open and close the door opening. Although not shown in the drawings, a suitable hinge mechanism is employed for the pivotal connection of the door 3 to the body 1.

A striker 4 is fixed to a free end of the door 3 to move therewith.

Figure 6:
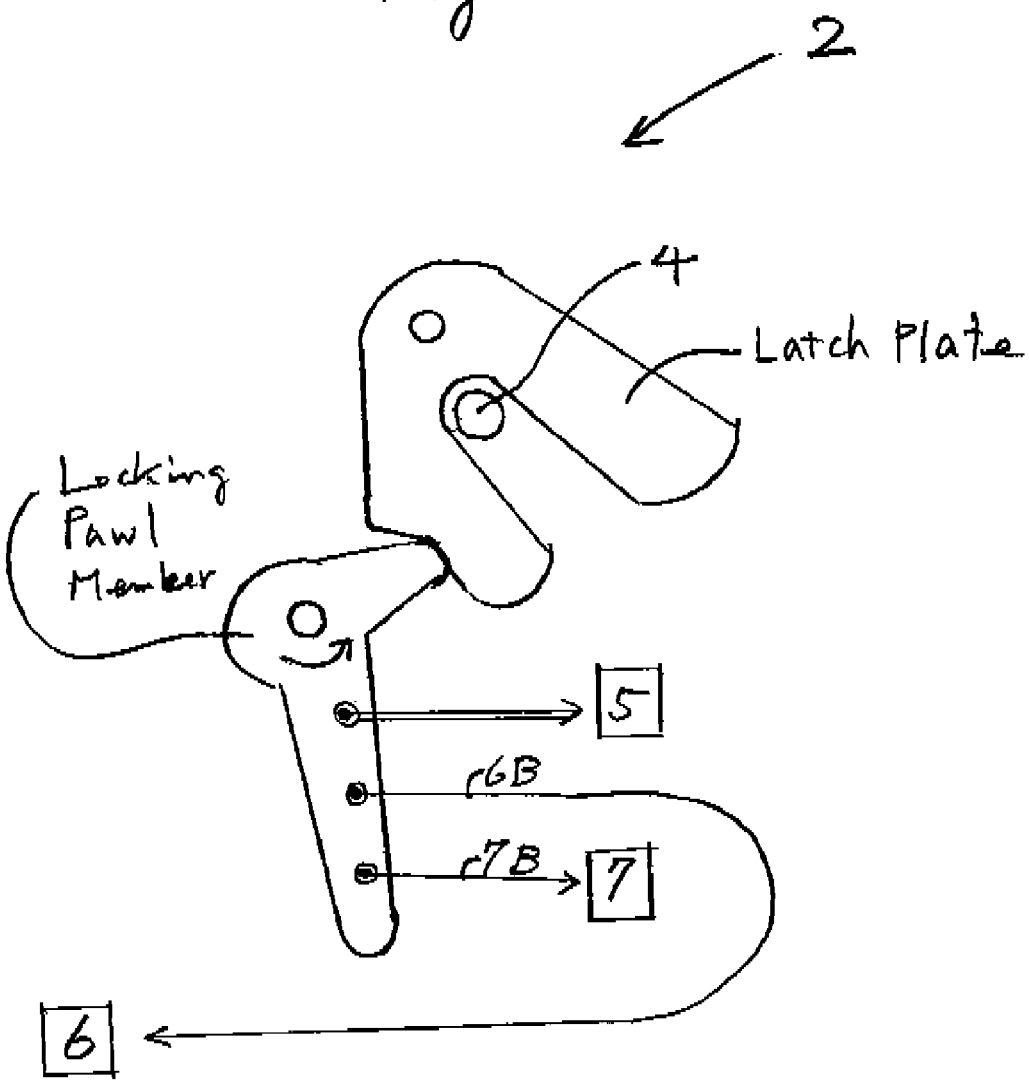
FIG. 6 is a schematic illustration of a latch unit, including a latch plate and locking pawl.

The latch unit 2 is of a type that is able to engage with the striker 4 to keep the door 3 at its full-closed position. That is, the latch unit 2 generally comprises a latch plate (See FIG. 6) that is engageable with the striker 4 and a locking pawl member (See FIG. 6) that is able to restrain the latch plate at a latch position, that is, a full-latch and/or half-latch position. That is, when the door 3 is in its full-close position, the latch unit 2 assumes the full-latch position.

The latch 2 is equipped with a first latch canceling mechanism 5 which is of an electric type and controllable by a passenger or driver in the vehicle and a person who carries the transmitter.

The first latch canceling mechanism generally comprises an electric actuator that is controlled by a control switch (not shown) positioned in the vehicle cabin and a power transmission link that extends between an output member of the electric actuator and the locking pawl member of the latch unit 2.

When, with the door 3 kept latched to the vehicle body 1 in a fully closed position as shown in FIG. 2, the control switch or the transmitter is manipulated, the electric actuator is energized and thus the output member of the actuator moves through the link the locking pawl member toward a latch plate releasing position. Upon this, the latch unit 2 releases the striker 4 and thus the door 3 becomes ready for opening.

In place of the electric actuator, various types of actuator may be used in the present invention, which are for example a hydraulic type, a pneumatic type, etc.

As is mentioned hereinabove, both the latch unit 2 and the first latch canceling mechanism 5 are placed on the vehicle body 1. This means that a power wire harness between the first latch canceling mechanism 5 and a battery mounted on the vehicle body 1 and a control wire harness between the latch unit 2 and the first latch canceling mechanism 5 can be short in length and simple in construction.

As is seen from FIGS. 1 and 2, in addition to the above-mentioned first latch canceling mechanism 5, second and third latch canceling mechanisms 6 and 7 are further employed, which are connected to the latch unit 2 to release the door 3 from the vehicle body 1 when operated.

The second latch canceling mechanism 6 is of an inner type that is controllable by a passenger in the vehicle, while the third latch canceling mechanism 7 is of an outer type that is controllable by a person who is out of the vehicle.

As is seen from FIGS. 1 and 2, the second latch canceling mechanism 6 comprises an emergency inside handle 6A (see FIG. 3) that is installed, for example, in a left side sill 1A of the vehicle in a manner to be controllable from the interior of the vehicle and a cable 6B that extends from the emergency inside handle 6A to the locking pawl member of the latch unit 2. If desired, the emergency inside handle 6A may be placed at an inconspicuous position in the vehicle cabin for the purpose of a car thief prevention. Furthermore, in place of the cable 6B, a link mechanism or a combination of the cable and links may be used.

Figure 3:
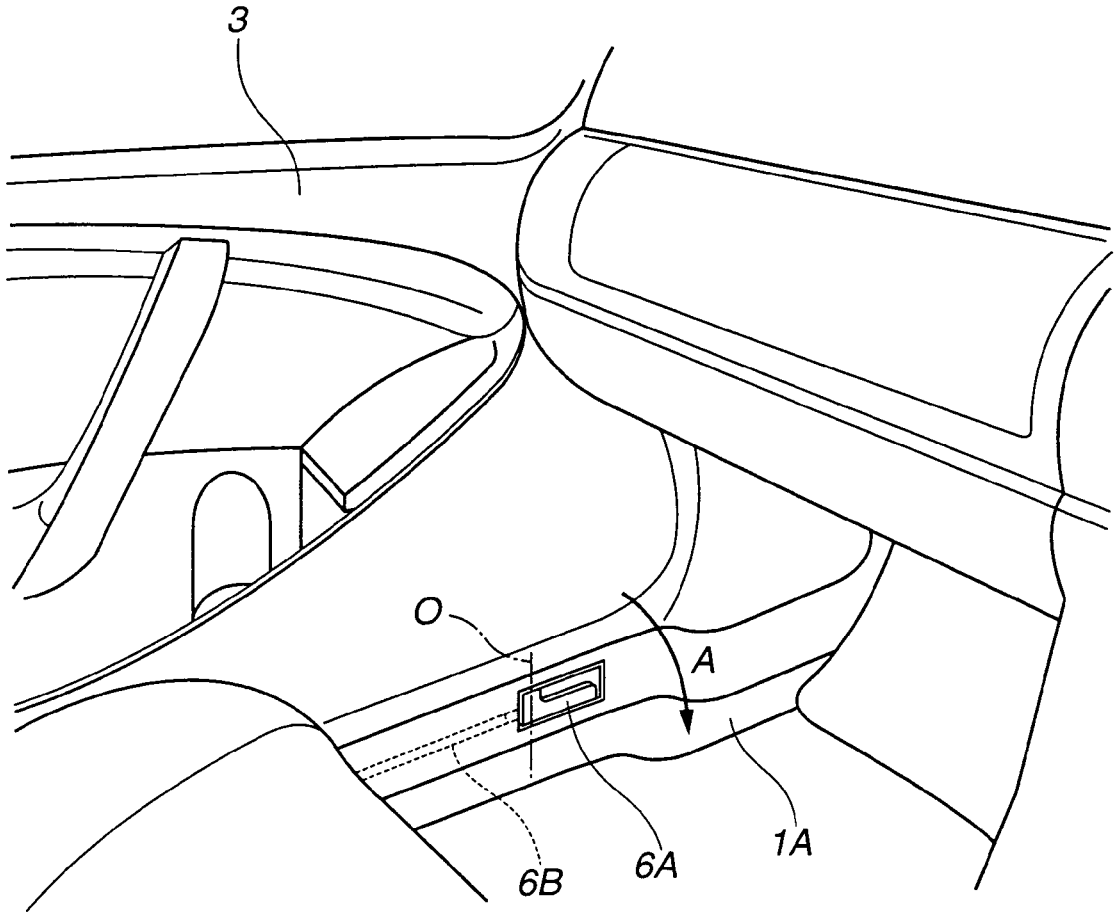
FIG. 3 is an interior view of the motor vehicle, showing a position where an inside handle member is located.

As is understood from FIG. 3, the emergency inside handle 6A is constructed to pivot about an axis "O".

When the emergency inside handle 6A is pulled or pivoted about the axis "O" in the direction of the arrow "A", the cable 6B is shifted toward the inside handle 6A thereby to move the locking pawl member of the latch unit 2 toward the latch plate releasing position. Upon this, the latch unit 2 releases the striker 4 and thus the door 3 becomes ready for opening.

As is seen from FIGS. 1 and 2, the third latch canceling mechanism 7 comprises an emergency outside handle 7A (see FIGS. 4 and 5) that is installed in a position of a trunk room "R" of the vehicle in a manner to be controllable from the interior of the trunk room "R" and a cable 7B that extends from the emergency outside handle 7A to the locking pawl member of the latch unit 2. Of course, in place of the cable 7B, a link mechanism or a combination of the cable and links may be used.

Figure 4:
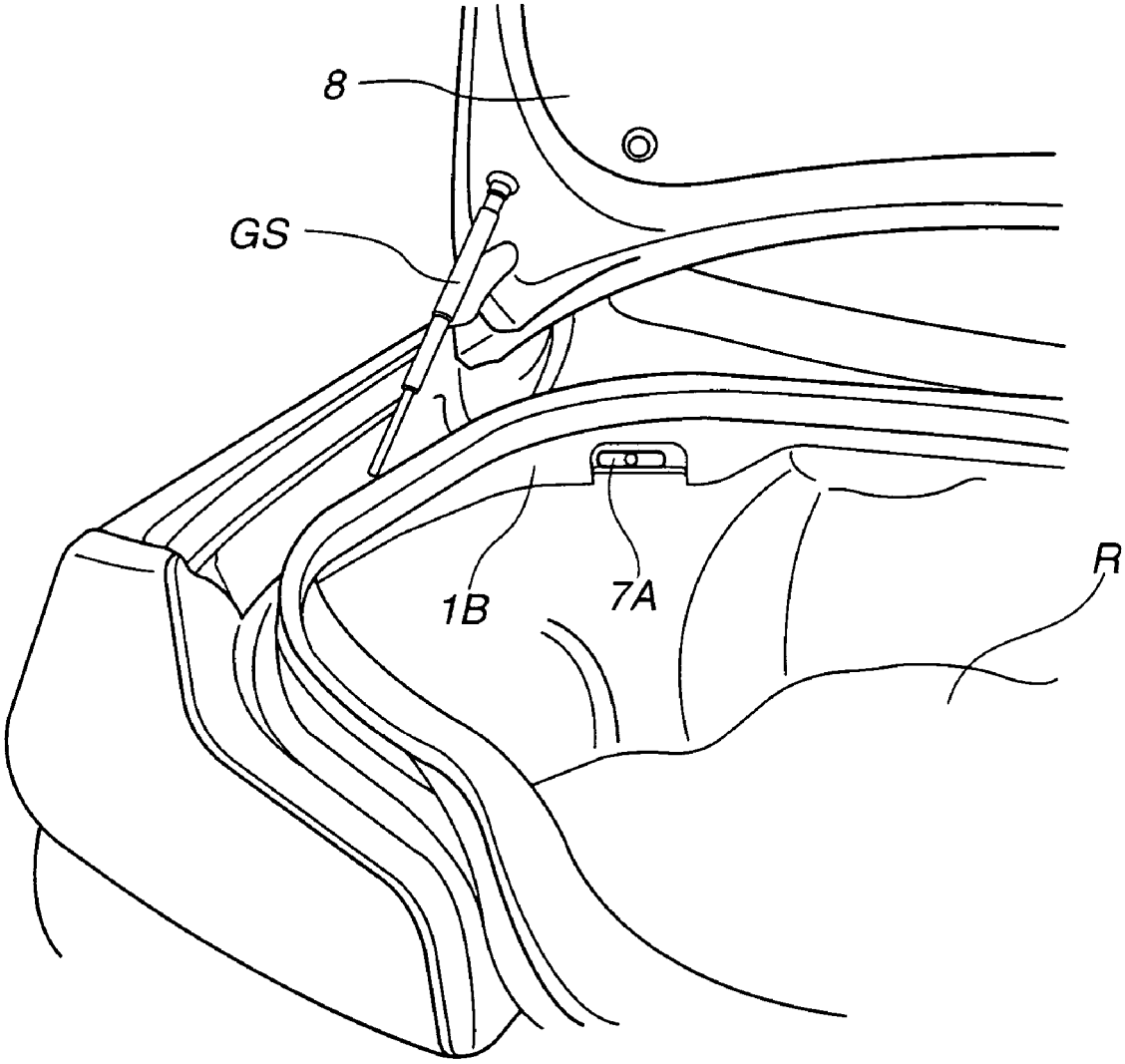
FIG. 4 is an interior view of a trunk room, showing a position where an outside handle member is located.
Figure 5:
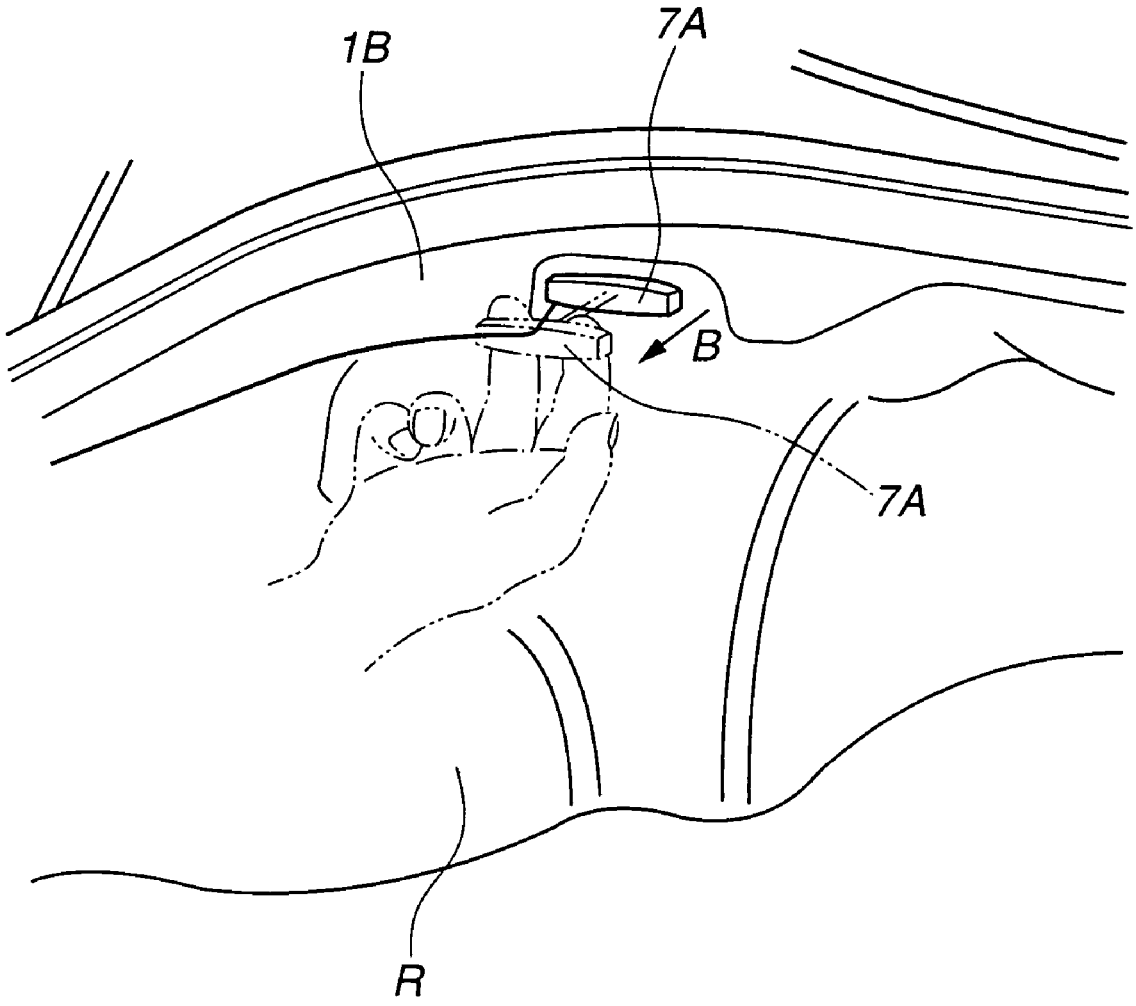
FIG. 5 is a view showing a manner for manipulating the outside handle member of FIG. 4.

As is seen from FIGS. 4 and 5, the emergency outside handle 7A is of a pull type that is constructed to draw the cable 7B when pulled in the direction of the arrow "B". In the disclosed embodiment, the handle 7A is placed at a mouth area 1B of the trunk room "R". However, if possible, the handle 7A should be placed at an inconspicuous position in the trunk room "R" for the car thief prevention.

When the emergency outside handle is pulled in the direction of the arrow "B", the cable 7B is shifted toward the outside handle 7B thereby to move the locking pawl member of the latch unit 2 toward the latch plate releasing position. Upon this, like in the above-mentioned manner, the latch unit 2 releases the striker 4 and thus the door 3 becomes ready for opening.

As is seen from FIGS. 2 and 4, the trunk room "R" is equipped with a trunk lid 8 that is pivotally connected to the vehicle body 1 at its front corners.

As is seen from FIG. 2, the trunk lid 8 is equipped with a lock device 9 that can be operated by a specified key, such as a trunk key, engine key or the like. That is, when, with the trunk lid 8 kept locked at its closed position, the key mated with the lock device 9 is turned in a given direction, the locked condition of the trunk lid 8 is canceled, and thus, the trunk lid 8 is ready for opening. Usually, upon this, the trunk lid 8 becomes fully opened due to the force of gas stays "GS" (see FIG. 4) that re incorporated with the trunk lid 8 as shown.

In the following, operation of the automotive door latch system of the present invention will be described.

For ease of description, the description will be commenced with respect to a condition wherein the door 3 is fully closed and the automotive door latch system of the invention operates normally.

Under this condition, the latch plate of the latch unit 2 is kept retained to the latch position by the locking pawl member while engaging with the striker 4.

In this condition, the door release operation by the latch unit 2 can be exclusively carried out by the first latch canceling mechanism 5. More specifically, upon need of the door release, the control switch is manipulated by a passenger or driver in the vehicle. Upon this, the electric actuator is energized to move through the link the locking pawl member of the latch unit 2 to the latch plate releasing position. Thus, the latch plate of the latch unit 2 releases the striker 4 of the door 3. Because of usage of the power produced by the electric actuator, the door release operation of the latch unit 2 is readily carried out with a less manual effort of the passenger.

While, if, due to shortage of the power of the battery or the like, the first latch canceling mechanism 5 fails to operate, the following emergency actions may take place for releasing the door 3.

If a passenger or driver is in the vehicle at the time of such failure, the emergency inside handle 6A is manipulated by him or her in the vehicle. Upon this, as has been mentioned hereinabove, the door 3 is released from the latch unit 2, and thus the door 3 becomes ready for opening.

If no passenger is present in the vehicle at the time of such failure, the emergency outside handle 7A is manipulated or pulled by a person who is out of the vehicle. Upon this, the door 3 becomes ready for opening. Of course, in this case, the trunk lid 8 has to be opened first by using the specified key. This door releasing method is quite advantageous when the latch unit 2, like in case of the present invention, is of a type that does not accept a lock canceling operation by a key in a key cylinder of the door 3.

As is described hereinabove, when the first (or power) latch canceling mechanism 5 fails to operate thereby to refuse ingress of a person into the vehicle, he or she may open the trunk room "R" by using a specified key and then pull the emergency outside handle 7A. With this action, the latched condition of the door 3 becomes canceled and thus the door 3 becomes ready for opening.

Because the latch unit 2 and the third latch canceling mechanism 7 are mounted on the vehicle body 1, the layout and arrangement of the cable 7B of the mechanism 7 are readily and simply made, which smoothes the movement of the cable 7B. That is, the manual operation of the emergency outside handle 7A is efficiently transmitted to the locking pawl member of the latch unit 2.

The latch unit 2 has a quite simple construction with only the latch plate and the locking pawl member. That is, by actuating the locking pawl member by at least one of the first, second and third latch canceling mechanism 5, 6 and 7, the latched condition of the door 3 becomes cancelled.

The entire contents of Japanese Patent Application 2004-296724 filed Oct. 8, 2004 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. A door latch system of a motor vehicle having a vehicle body, a side sill and a cabin side door, comprising:

a striker fixed to the cabin side door;

a latch unit comprising a latch plate which engages the striker and a locking pawl member that is able to restrain the latch plate at a latch position, the latch unit being mounted to the vehicle body and having a latch condition to latch the cabin side door and an unlatch condition to unlatch the cabin door thereby to release the door;

a power latch canceling mechanism mounted to the vehicle body, the power latch canceling mechanism comprising an electric actuator which, when electrically energized, enforcedly causes the latch unit to assume the unlatch condition; and a manual latch canceling mechanism mounted to the vehicle body, the manual latch canceling mechanism comprising an emergency handle placed in a trunk room of the vehicle and a cable which transmits a movement of the emergency handle to the latch unit, the manual latch canceling mechanism causing the latch unit to assume the unlatch condition when the emergency handle is manipulated, and another manual latch canceling mechanism that is mounted to the vehicle body and comprises a handle member that is installed in the side sill of the vehicle in a manner to be controllable from the interior vehicle and a cable that transmits a movement of the handle member to the latch unit, the another manual latch canceling mechanism causing the latch unit to assume the unlatch condition when the handle member is manipulated;

wherein the cable of the manual latch canceling mechanism is arranged in the vehicle body and extends substantially horizontally between the latch unit and the emergency handle in a direction corresponding to the length of the vehicle body, to cause the latch unit to assume the unlatch condition when the emergency handle is pulled away from the latch unit;

wherein the trunk room of the vehicle is equipped with a pivotally movable trunk lid, the trunk lid being equipped with a lock device by which the trunk lid is locked to the trunk room while assuming its close position;

the emergency handle of the manual latch canceling mechanism is arranged at a mouth area of the trunk room;

the locking pawl member of the latch unit is moved by the electric actuator of the power latch canceling mechanism, and the power transmitting member of the another manual latch canceling mechanism is a cable that is led and connected to the locking pawl member of the latch unit;

the cable of the manual latch canceling mechanism is led and connected to the locking pawl member of the latch unit; and the emergency handle of the manual latch canceling mechanism has a T-shaped construction.

2. A door latch system of a motor vehicle having a vehicle body, a side sill and a cabin side door, comprising:

a striker fixed to the cabin side door;

a latch unit comprising a latch plate which engages the striker and a locking pawl member that is able to restrain the latch plate at a latch position, and is mounted to the vehicle body, the latch unit having a latch condition to latch the cabin side door at a closed position through the striker and an unlatch condition to unlatch the cabin side door through the striker thereby to release the cabin side door;

a first latch canceling mechanism mounted to the vehicle body, the first latch canceling mechanism comprising an electric actuator that, when electrically energized, enforcedly causes the latch unit to assume the unlatch condition;

a second latch canceling mechanism mounted to the vehicle body, the second latch canceling mechanism comprising an inner handle member that is installed in the side sill of the vehicle in a manner to be controllable from the interior of the vehicle and a cable that transmits a movement of the inner handle to the latch unit, the second latch canceling mechanism causing the latch unit to assume the unlatch condition when the inner handle member is manipulated; and a third latch canceling mechanism mounted to the vehicle body, the third latch canceling mechanism including an emergency handle that is placed in a trunk room of the vehicle and a cable arranged substantially horizontally in a direction corresponding to the length of the vehicle body, that transmits a movement of the emergency handle to the latch unit, the third latch canceling mechanism causing the latch unit to assume the unlatch condition when the cable is pulled away from the latch unit;

wherein the trunk room of the vehicle is equipped with a pivotally movable trunk lid, the trunk lid being equipped with a lock device by which the trunk lid is locked to the trunk room while assuming its close position;

the emergency handle of the third latch canceling mechanism is arranged at a mouth area of the trunk room;

the locking pawl member of the latch unit is moved by the electric actuator of the first latch canceling mechanism, and the cable of the second latch canceling mechanism is led and connected to the locking pawl member of the latch unit;

the cable of the third latch canceling mechanism is led and connected to the locking pawl member of the latch unit; and the emergency handle of the third latch canceling mechanism has a T-shaped construction.

* * * * *